US012484721B2

(12) United States Patent
Brown et al.

(10) Patent No.: US 12,484,721 B2
(45) **Date of Patent: *Dec. 2, 2025**

(54) PILLOW

(71) Applicant: Hit Notions, LLC, Detroit, MI (US)

(72) Inventors: Vita-Anne Brown, Detroit, MI (US); Jason Berke, Bloomfield, MI (US)

(73) Assignee: Hit Notions, LLC, Detroit, MI (US)

( * ) Notice: Subject to any disclaimer, the term of this patent is extended or adjusted under 35 U.S.C. 154(b) by 214 days.

This patent is subject to a terminal disclaimer.

(21) Appl. No.: 17/129,360

(22) Filed: Dec. 21, 2020

(65) Prior Publication Data

US 2021/0106157 A1 Apr. 15, 2021

Related U.S. Application Data

(63) Continuation of application No. 29/717,095, filed on Dec. 13, 2019, now Pat. No. Des. 949,600, and a continuation-in-part of application No. 15/849,702, filed on Dec. 21, 2017, said application No. 29/717,095 is a continuation of application No. 29/622,761, filed on Oct. 19, 2017, now Pat. No. Des. 875,432.

(51) Int. Cl.
*A47G 9/10* (2006.01)

(52) U.S. Cl.
CPC ..... *A47G 9/1072* (2013.01); *A47G 9/1081* (2013.01)

(58) Field of Classification Search
CPC ..... A47G 9/1072; A47G 9/1081; A61G 7/07
See application file for complete search history.

(56) References Cited

U.S. PATENT DOCUMENTS 200,504 A * 2/1878 Buell ..... A47C 20/027 5/643
2,623,574 A * 12/1952 Damsch ..... A47C 1/146 5/705
2,708,475 A * 5/1955 Krewson ..... A47C 7/425 297/284.7

(Continued)

FOREIGN PATENT DOCUMENTS

CN 201295056 Y * 8/2009
FR 1196483 A * 11/1959

(Continued)

OTHER PUBLICATIONS https://www.amazon.com/Cheer-Collection-Foam-Filled-Detachable-Washable/dp/B074F4TD61/ref=cm_cr_arp_d_product_top?ie=UTF8&th=1 accessed Jan. 27, 2021 (Year: 2017).*

*Primary Examiner* — Eric J Kurilla
(74) *Attorney, Agent, or Firm* — Howard & Howard Attorneys PLLC

(57) ABSTRACT

A pillow for ergonomically supporting a user includes a central supporting pillow having at least two arm support members extending from the central supporting pillow, an adjustable neck support member being cylindrical in shape and having an outer surface, and a bungee cord attached to the neck support member and the central support pillow, wherein the neck support member is freely adjustable and detachably attached using the bungee cord, the bungee cord having one end attached to a top surface of the central supporting pillow and another end attached to the outer surface of the adjustable neck support member to ergonomically support a back and a neck of the user.

6 Claims, 17 Drawing Sheets

(56) References Cited

U.S. PATENT DOCUMENTS 3,137,012 A 6/1964 Halterman
3,195,953 A * 7/1965 Zacks ..... A47C 7/383 297/410
3,235,892 A 2/1966 Emery
3,273,174 A 9/1966 Genaro
3,293,669 A * 12/1966 Emery ..... A47C 20/027 5/633
3,840,916 A 10/1974 Jennings
4,197,604 A * 4/1980 Nakamura ..... A47G 9/1045 446/72
4,206,945 A * 6/1980 Kifferstein ..... B60N 2/6036 5/640
4,853,275 A 8/1989 Tracy et al.
4,889,388 A * 12/1989 Hime ..... A47D 15/006 297/464
D305,288 S * 1/1990 Eldridge ..... D21/604
5,115,529 A 5/1992 White
5,423,098 A * 6/1995 Swezey ..... A47C 20/027 297/410
5,425,567 A * 6/1995 Albecker, III ..... A47C 1/146 297/452.29
5,515,563 A * 5/1996 Chao ..... A47G 9/1045 5/632
D376,503 S * 12/1996 Petersson ..... D6/596
5,581,833 A 12/1996 Zenoff
D382,164 S * 8/1997 Hays ..... D6/601
5,895,365 A * 4/1999 Tomlinson ..... A47C 20/027 297/149
5,964,504 A * 10/1999 Hogan ..... A47C 7/383 297/400
D427,833 S * 7/2000 Robinson ..... D6/601
6,126,237 A * 10/2000 Ritterhouse ..... A47C 7/383 297/410
6,357,061 B1 3/2002 Gonzalez
6,434,769 B1 8/2002 Koenig
6,435,617 B1 * 8/2002 McNair ..... A47C 7/383 297/397
6,669,300 B1 * 12/2003 Lee ..... B60N 2/882 297/397
6,748,615 B1 6/2004 Tiedemann
6,782,572 B1 8/2004 Jones
6,814,709 B2 * 11/2004 Schwartz ..... A47C 7/725 5/633
7,086,105 B1 * 8/2006 Gottlieb ..... A47C 21/026 5/492
7,284,290 B1 * 10/2007 Swezey ..... A47C 20/027 5/630
7,313,836 B1 * 1/2008 Swezey ..... A47C 20/027 297/230.1
7,328,470 B2 * 2/2008 Harris, Jr. ..... A47C 20/027 297/230.1
7,346,948 B1 * 3/2008 Swezey ..... A47C 5/005 5/653
7,412,738 B2 * 8/2008 Chaffee ..... A47C 20/027 5/655.3
7,547,071 B2 * 6/2009 Huffman ..... A47C 7/383 297/DIG. 6
8,181,599 B1 5/2012 Jeffers
8,448,275 B1 * 5/2013 Leach ..... A47C 7/021 5/655
8,459,737 B2 6/2013 Brotsch
D747,612 S * 1/2016 Jensen ..... D6/601
9,693,638 B1 7/2017 Leach
D875,432 S * 2/2020 Brown ..... D6/601
11,039,699 B1 * 6/2021 Leach ..... A47G 9/1072
D948,060 S * 4/2022 Szparski ..... D24/190
2001/0052153 A1 * 12/2001 Schwartz ..... A47C 7/725 5/905
2002/0063453 A1 5/2002 Terry
2002/0163240 A1 * 11/2002 Cheng ..... A47C 7/383 297/397
2003/0038521 A1 2/2003 Johnson
2003/0200611 A1 * 10/2003 Chaffee ..... A47C 27/085 5/710
2006/0214476 A1 * 9/2006 Rojas ..... A47C 7/383 297/3
2007/0052274 A1 3/2007 Morphew et al.
2007/0271703 A1 11/2007 Matthews et al.
2008/0164734 A1 * 7/2008 Nile ..... A47C 7/425 297/230.13
2009/0151078 A1 * 6/2009 Soehner ..... A47G 9/007 5/639
2010/0242178 A1 * 9/2010 Goetting ..... A47C 20/027 5/633
2011/0031799 A1 2/2011 DeJoode
2013/0119716 A1 * 5/2013 Stronconi ..... B60N 2/882 297/180.1
2013/0139320 A1 6/2013 Tzameret
2014/0191544 A1 7/2014 Comber
2015/0074953 A1 * 3/2015 Dershem ..... F16B 45/00 24/301
2015/0265062 A1 * 9/2015 Blyberg ..... B60N 2/806 248/118
2017/0164754 A1 * 6/2017 Alletto, Jr. ..... A47C 20/027
2017/0332802 A1 * 11/2017 Stern ..... A61G 7/05769
2019/0191900 A1 * 6/2019 Brown ..... A47C 7/36
2020/0022510 A1 * 1/2020 Shokrian ..... A47G 9/10
2021/0186238 A1 * 6/2021 Kilo ..... A47G 9/1045

FOREIGN PATENT DOCUMENTS

FR 2336105 A1 * 7/1977
FR 2401641 A1 * 3/1979
FR 2576500 A3 * 8/1986
GB 333738 A * 8/1930
GB 1277861 A * 6/1972
JP 3080745 U * 10/2001
WO WO-9628069 A1 * 9/1996 ..... A47C 1/143
WO WO-2012078596 A2 * 6/2012 ..... A47C 20/027
WO WO-2021174296 A1 * 9/2021 ..... A47C 7/425

* cited by examiner

PILLOW

CROSS-REFERENCE TO RELATED APPLICATIONS

The present application is a continuation application of U.S. Ser. No. 29/717,095, filed Dec. 13, 2019, which is a continuation application of U.S. Ser. No. 29/622,761, filed Oct. 19, 2017, now U.S. Design Patent No. D875,432, issued Feb. 18, 2020, and is a continuation-in-part application of U.S. patent application Ser. No. 15/849,702, filed Dec. 21, 2017, the entire disclosures of which are hereby incorporated by reference in its entirety and for all purposes.

TECHNICAL FIELD OF THE INVENTION

The present invention generally relates to pillows. More particularly, the present invention, disclosed herein, relates to a pillow for ergonomically supporting a user.

BACKGROUND OF THE INVENTION

Pillows have been used since ancient times to improve comfort of individuals while sleeping. Pillows have also addressed the problem of recurring back aches, shoulder pains, and neck aches by improving posture while sleeping. Over the years, pillows have been used for both decorative and orthopedic purposes. For instance, threw pillows are used to beautify or improve the aesthetics of the living room or the bedroom. Alternately, lumbar pillows are designed to support the inward curve of the lower back of an individual thereby alleviating pressure on the lower back. Support pillows, on the other hand, are pillows that help position an individual erect while lying on the floor or on a bed for reading or watching television. As such, support pillows are also termed as "reading pillows".

Typically, support pillows are designed to support the lower to mid spinal area and the arms of an individual. Existing support pillows lack the vertical size required to support the shoulder or neck areas of a user. Additionally, existing support pillows lack a headrest or neck support which provides support to the neck area of the user. A pillow which provides ample support to both the spinal and neck regions of a user simultaneously, is therefore required. Furthermore, it is highly advantageous to a user for the headrest or neck support to be adjustable and removable. A pillow, which has, an adjustable headrest or neck support that is also removable, is required.

Hence, there is a long felt but unresolved need for a pillow, which provides ample support to both the spinal and neck regions of a user simultaneously. Furthermore, there is a need for a pillow, which has an adjustable headrest or neck support that is also removable.

SUMMARY OF THE INVENTION

This summary is provided to introduce a selection of concepts in a simplified form that are further disclosed in the detailed description of the present invention. This summary is not intended to identify key or essential inventive concepts of the claimed subject matter, nor is it intended to determine the scope of the claimed subject matter.

The present invention, disclosed herein, addresses the above-mentioned need for a pillow, which provides ample support to both the spinal and neck regions of a user simultaneously. Furthermore, there is a need for a pillow, which has an adjustable headrest or neck support that is also removable.

It is an object of the present invention to provide a pillow that can support the spinal and neck regions of a user. Further, it is an object of the present invention to provide a pillow having an adjustable and removable headrest or neck support. Moreover, it is an object of the present invention to provide a pillow having multiple storage compartments for storing one or more objects.

The present invention provides a pillow for ergonomically supporting a user including a central supporting pillow having at least two arm support members extending from the central supporting pillow. The pillow also includes an adjustable neck support member being cylindrical in shape and having an outer surface, and a bungee cord attached to the neck support member and the central support pillow. The neck support member is freely adjustable and detachably attached using the bungee cord. The bungee cord has one end attached to a top surface of the central supporting pillow and another end attached to the outer surface of the adjustable neck support member to ergonomically support a back and a neck of the user.

The present invention also provides a pillow for ergonomically supporting a user including a central supporting pillow having at least two arm support members extending from the central supporting pillow. The pillow also includes an adjustable neck support member being cylindrical in shape and having an outer surface, and a bungee cord attached to the neck support member and the central support pillow. The neck support member is freely adjustable and detachably attached using the bungee cord. The bungee cord has one end attached to a top surface of the central supporting pillow and another end attached to the cylindrical portion of the adjustable neck support member to ergonomically support a back and a neck of the user.

The present invention further provides a pillow for ergonomically supporting a user including a central support pillow, at least two arm support members, and a neck support member. The central support pillow includes a front surface, a rear surface, a top surface, and a bottom surface. The front surface of the central support pillow is configured to contact a back of the user and conform to the back of the user. The two arm support members extend outward from the front surface of the central support pillow and the at least two arm support members are positioned proximal to the bottom surface of the central support pillow to support arms of the user. The neck support member has a cylindrical portion and opposing end portions and an elongated attachment member having one end attached to the cylindrical portion of the neck support member and another end detachably attached to the top surface of the central support pillow. The neck support member is freely adjustable and detachably attached using the attachment member relative to a top surface of the central supporting pillow to ergonomically support a neck of the user.

In an embodiment, the pillow, disclosed herein, for ergonomically supporting a user includes a central support pillow, at least two arm support members, and a neck support member. The central support pillow includes a front surface, a rear surface, a top surface, and a bottom surface. The front surface of the central support pillow is configured to contact the back of the user and conform to the back of the user. The arm support members extend outward from the front surface of the central support pillow. Additionally, the arm support members are positioned proximal to the bottom surface of the central support pillow to support arms of the user. A plurality of storage compartments is configured on the at least two arm support members and the central support pillow for storing one or more objects. The neck support member is detachably attached to a top surface of the central support pillow to support a neck of the user. The central support pillow, the at least two arm support members, and the neck support member ergonomically support the back, the neck, and the arms of the user respectively.

BRIEF DESCRIPTION OF THE FIGURES

The foregoing summary, as well as the following detailed description of the present invention, is better understood when read in conjunctions with the appended drawings. For the purpose of illustrating; the present invention, exemplary constructions of the present invention are shown in the drawings. However, the present invention is not limited to the specific methods, components, and structures disclosed herein. The description of a method step, a component, or a structure referenced by a numeral in a drawing is applicable to the description of that method step, component, or structure shown by that same numeral in any subsequent drawing herein.

DETAILED DESCRIPTION OF THE EMBODIMENTS

FIGS. 1-8 exemplarily illustrate an ornamental design for a pillow, according to an embodiment of the present invention.

Figure 1:
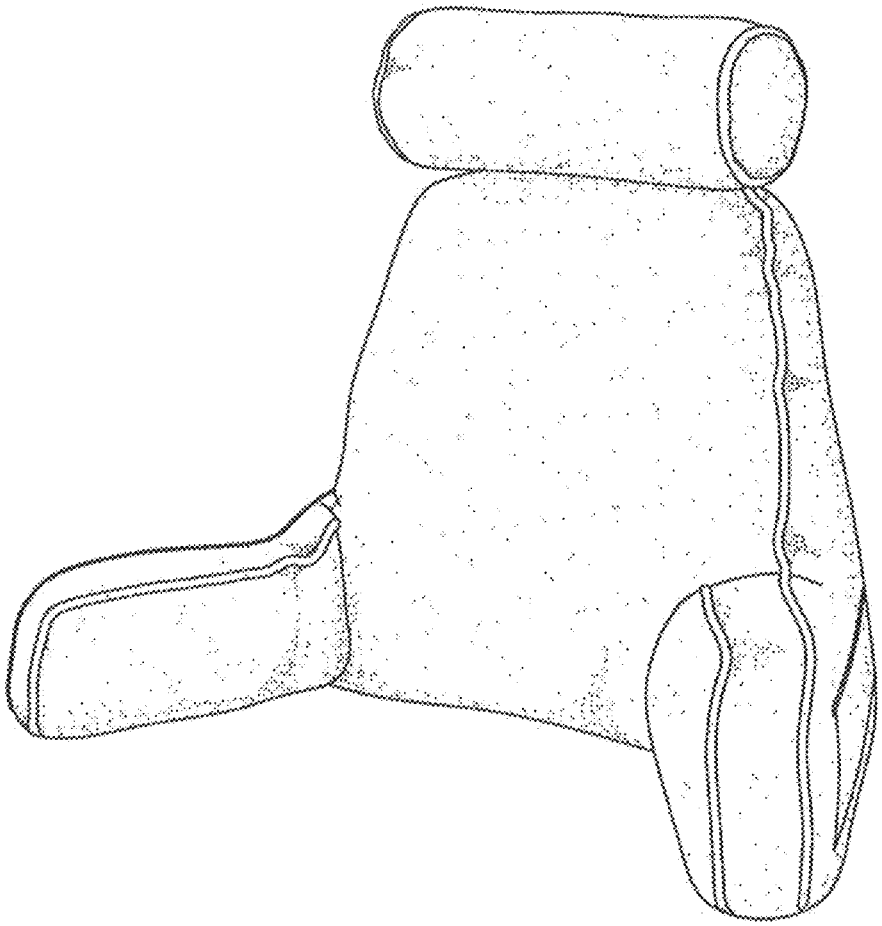
FIG. 1 is a top, front, right perspective view of a pillow, showing a new design, according to an embodiment of the present invention.
Figure 2:
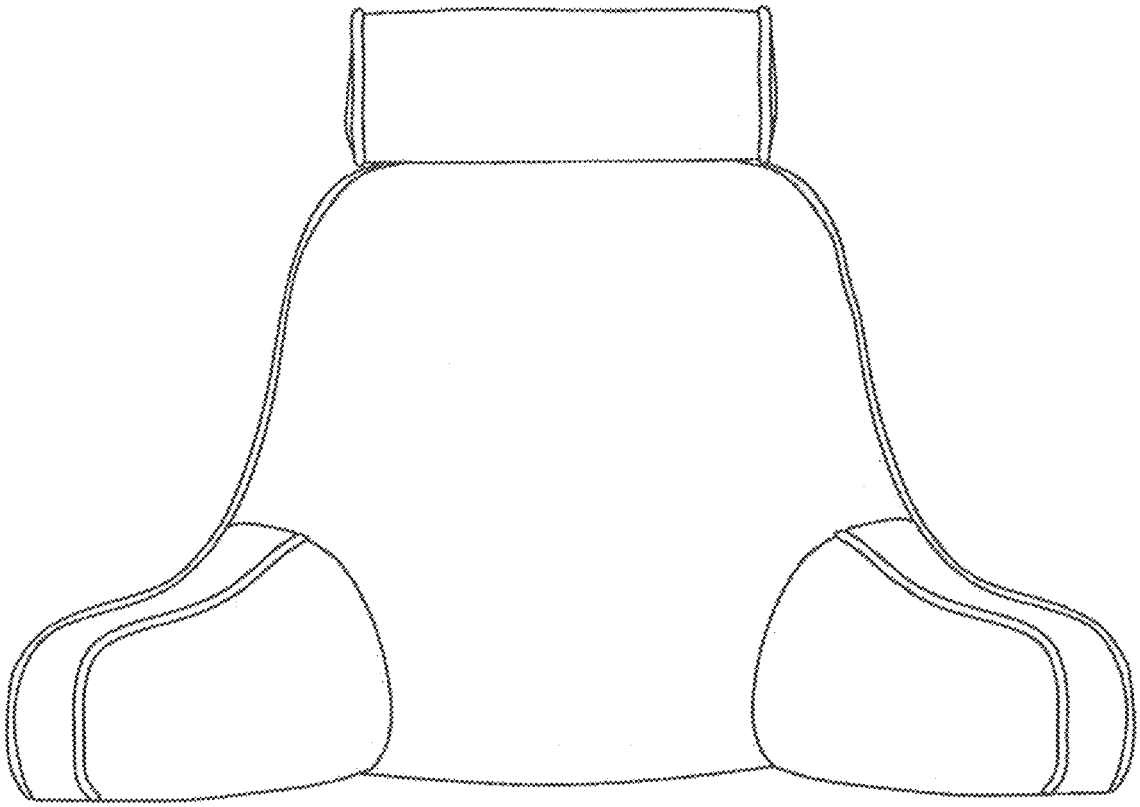
FIG. 2 is a front view thereof.
Figure 3:
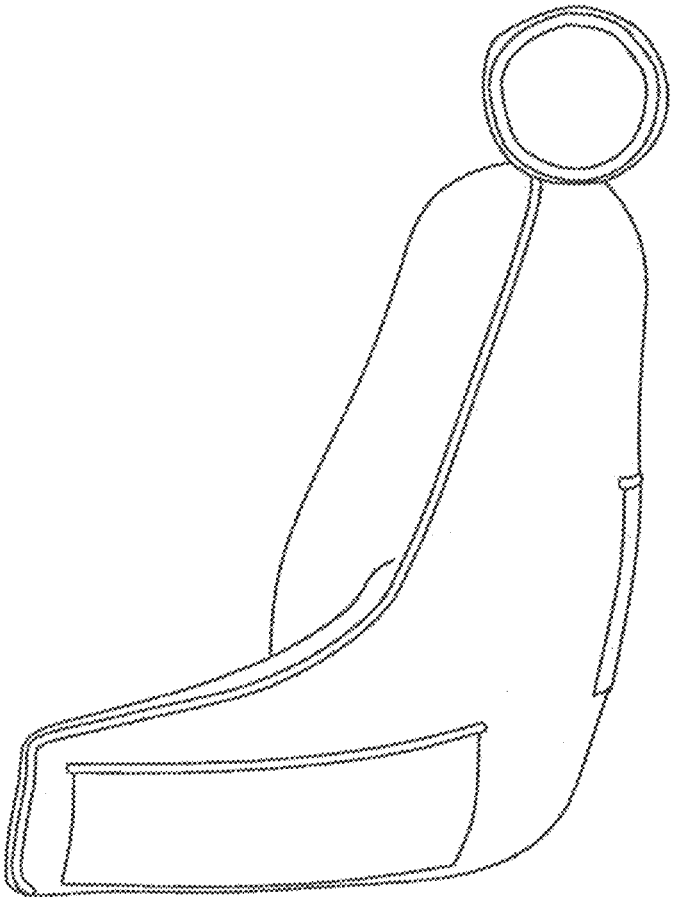
FIG. 3 is a right side view thereof.
Figure 4:
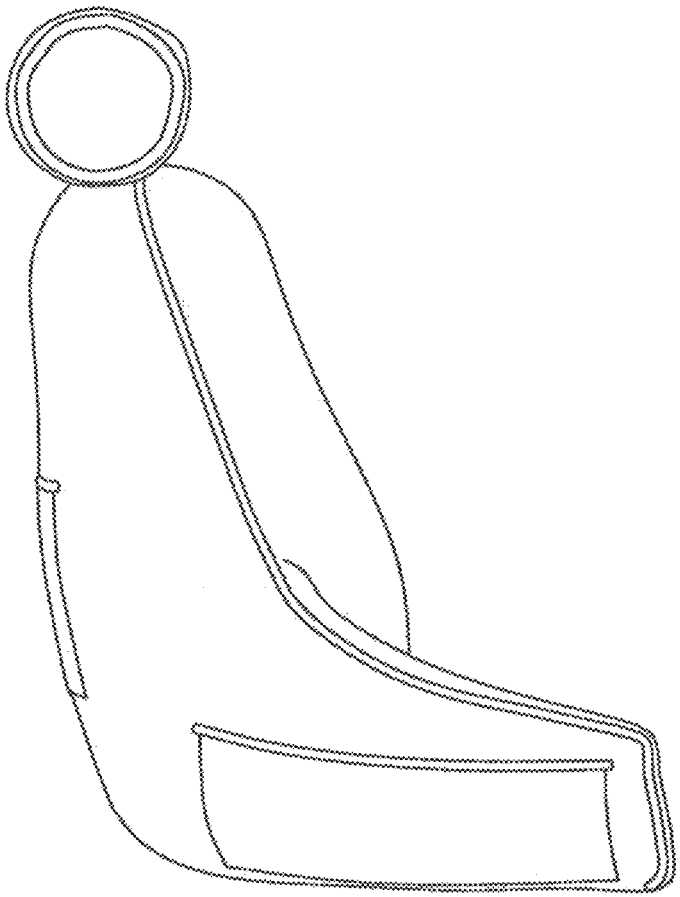
FIG. 4 is a left side view thereof.
Figure 5:
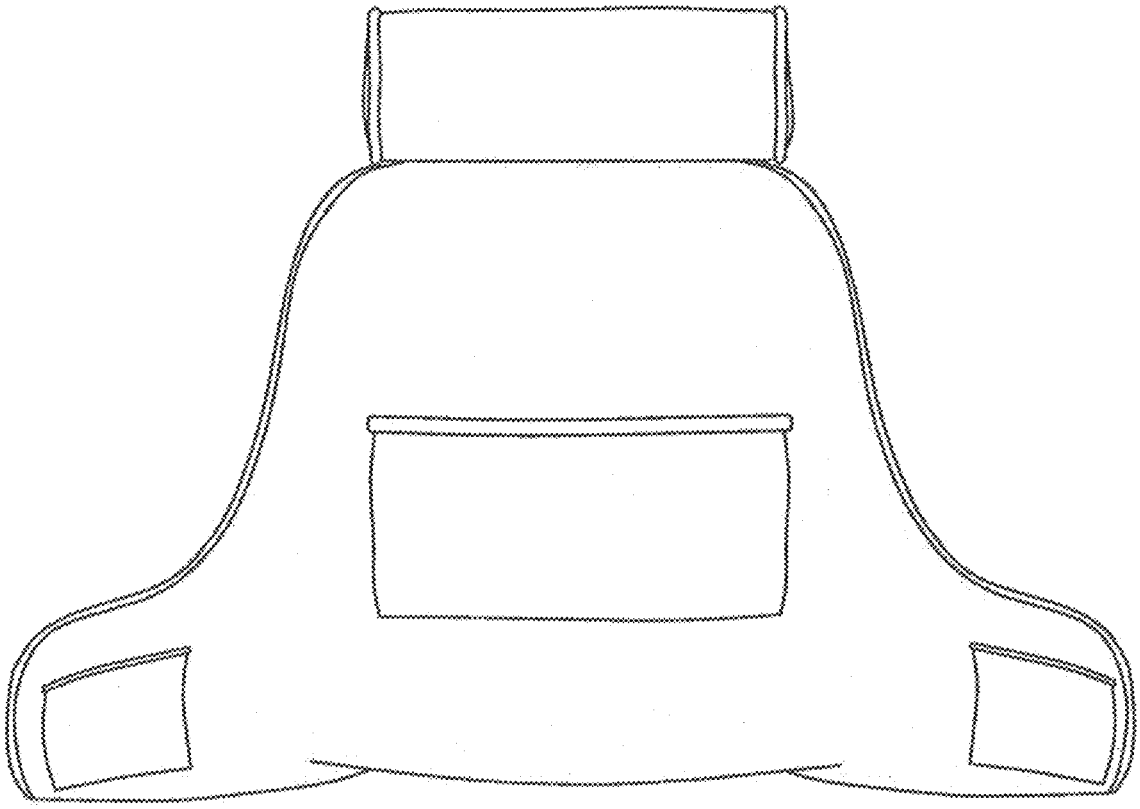
FIG. 5 is a rear view thereof.
Figure 6:
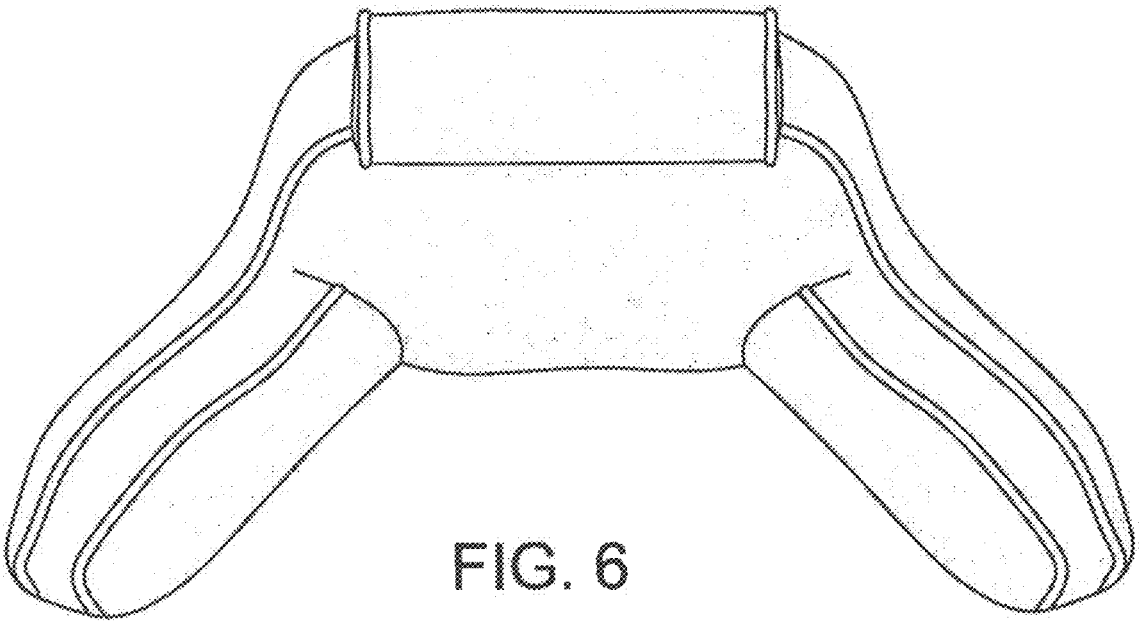
FIG. 6 is a top view thereof.
Figure 7:
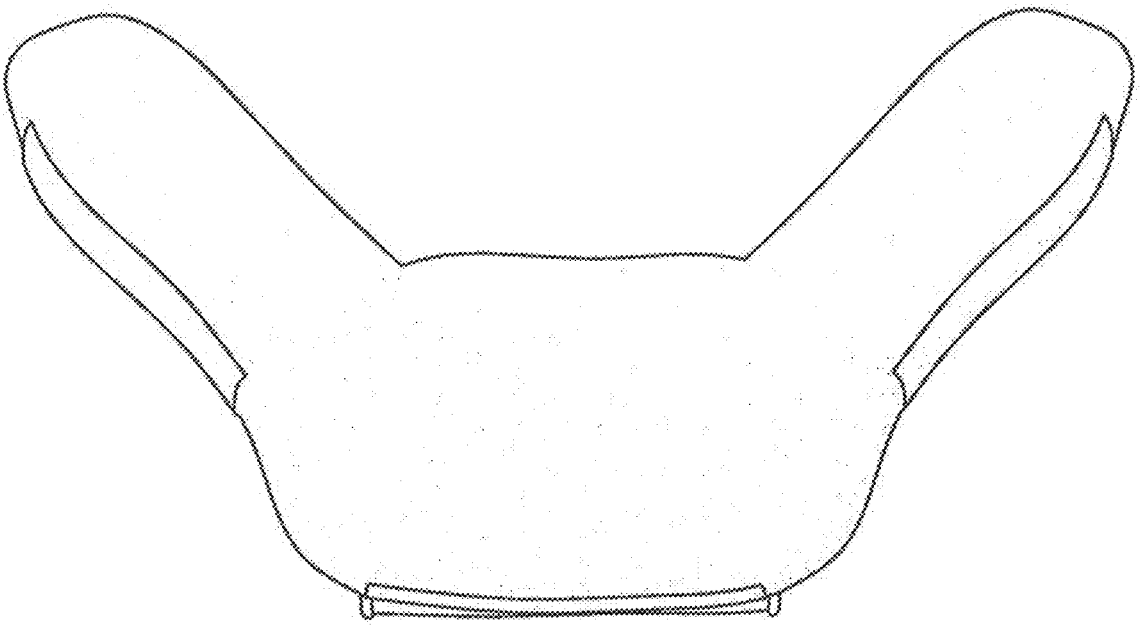
FIG. 7 is a bottom view thereof.
Figure 8:
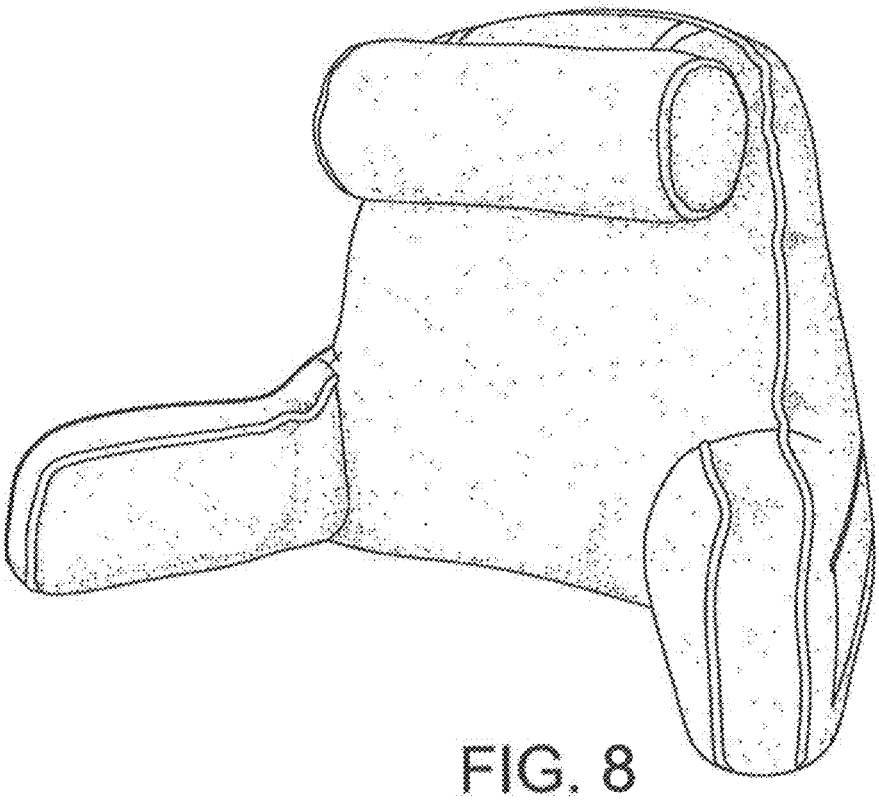
FIG. 8 is a top, front right perspective view thereof with a head pillow portion or neck support member positioned downwardly from that shown in FIG. 1.
Figure 9:
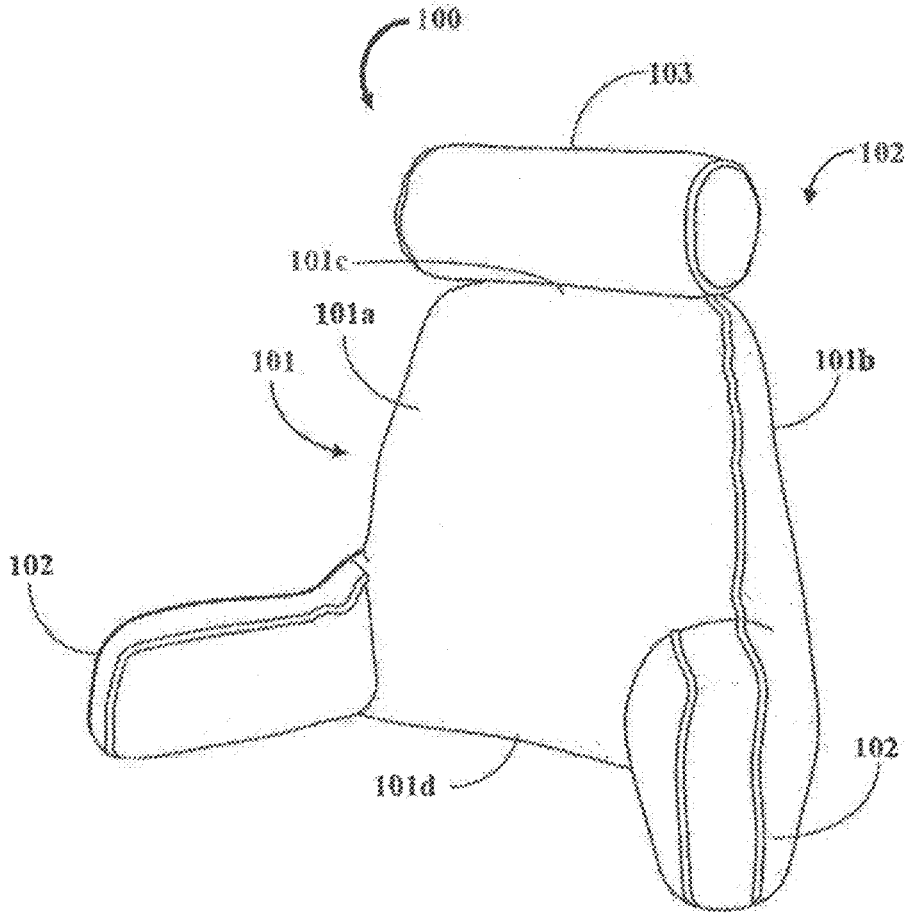
FIG. 9 exemplarily illustrates a front perspective view of a pillow, according to an embodiment of the present invention.
Figure 10:
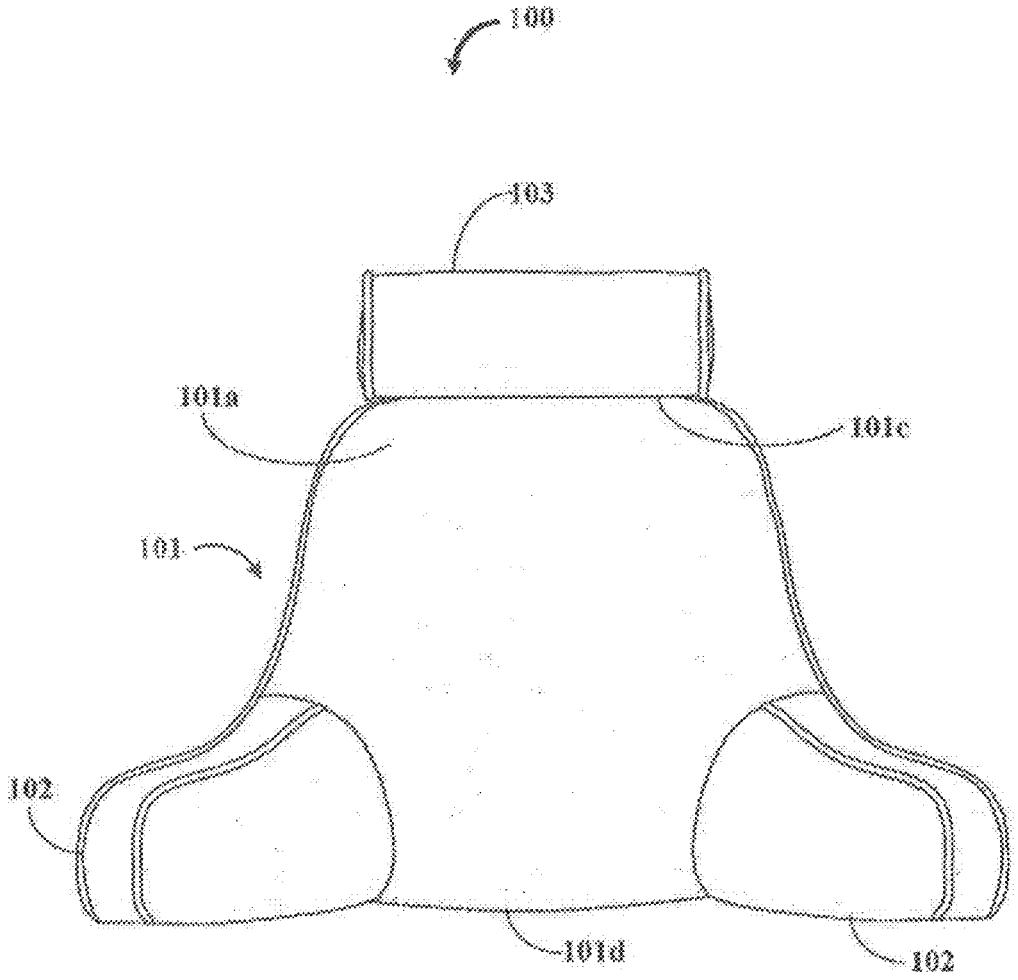
FIG. 10 exemplarily illustrates a front elevation view of the pillow of FIG. 9.

FIG. 9 exemplarily illustrates a front perspective view of a pillow 100, according to an embodiment of the present invention. FIG. 10 exemplarily illustrates a front elevation view of the pillow 100. The pillow 100 for ergonomically supporting a user includes a central support pillow 101, at least two arm support members 102, and a neck support member 103. The central support pillow 101 includes a front surface 101*a*, a rear surface 101*b*, a top surface 101*c*, and a bottom surface 101*d*. In an embodiment the exterior of the central support pillow 101, the arm support members 102, and the neck support member 103 is made of a natural or synthetic fiber, for example, polyester, rubber, cotton, etc. Further, the interior of the central support pillow 101, the arm support members 102, and the neck support member 103 are made of filler materials, for example, foam, cotton, poly-fill, memory foam, Styrofoam beads, etc. The filler materials may also include a combination of gases and foam or only include gases. In one embodiment, the neck support member 103 is generally cylindrical in shape. In one embodiment, the neck support member 103 has a cylindrical portion 103*a* extending axially and end portions 103*b* at each axial end of the cylindrical portion 103*a*. The neck support member 103 also has an outer surface 103*c* and a zip fastener or zipper 103*d* (FIG. 16) along the outer surface 103*c* to allow the filler materials to be removed from an interior thereof. The central support pillow 101 and the arm support members 102 are a single compact unit and the external fiber provides an airtight seal to the filler material contained within.

The front surface 101*a* of the central support pillow 101 is configured to contact the back of the user and conform to the back of the user. The at least two support members 102 extend outward from the front surface 101*a* of the central support pillow 101. In an embodiment, the at least two arm support members 102 are positioned proximal to the bottom surface 101*d* of the central support pillow 101 to support the arms of the user. A plurality of storage compartments 104 is configured on the at least two arm support members 102 and the central support pillow 101 for storing one or more objects as exemplarily illustrated in FIGS. 11 and 12. The neck support member 103 is detachable attached to a top surface 101*c* of the central support pillow 101 to support a neck of the user. The front surface 101*a* of the central support pillow 101, the at least two arm support members 102, and the neck support member 103 ergonomically support the back, the arms, and the neck of the user respectively to provide a comfortable position when a user is laying down or partially seated. In an embodiment, the arm support members 102 are positioned at an angle, for example, around 90-120 degrees, relative to the central support pillow 101.

Figure 11:
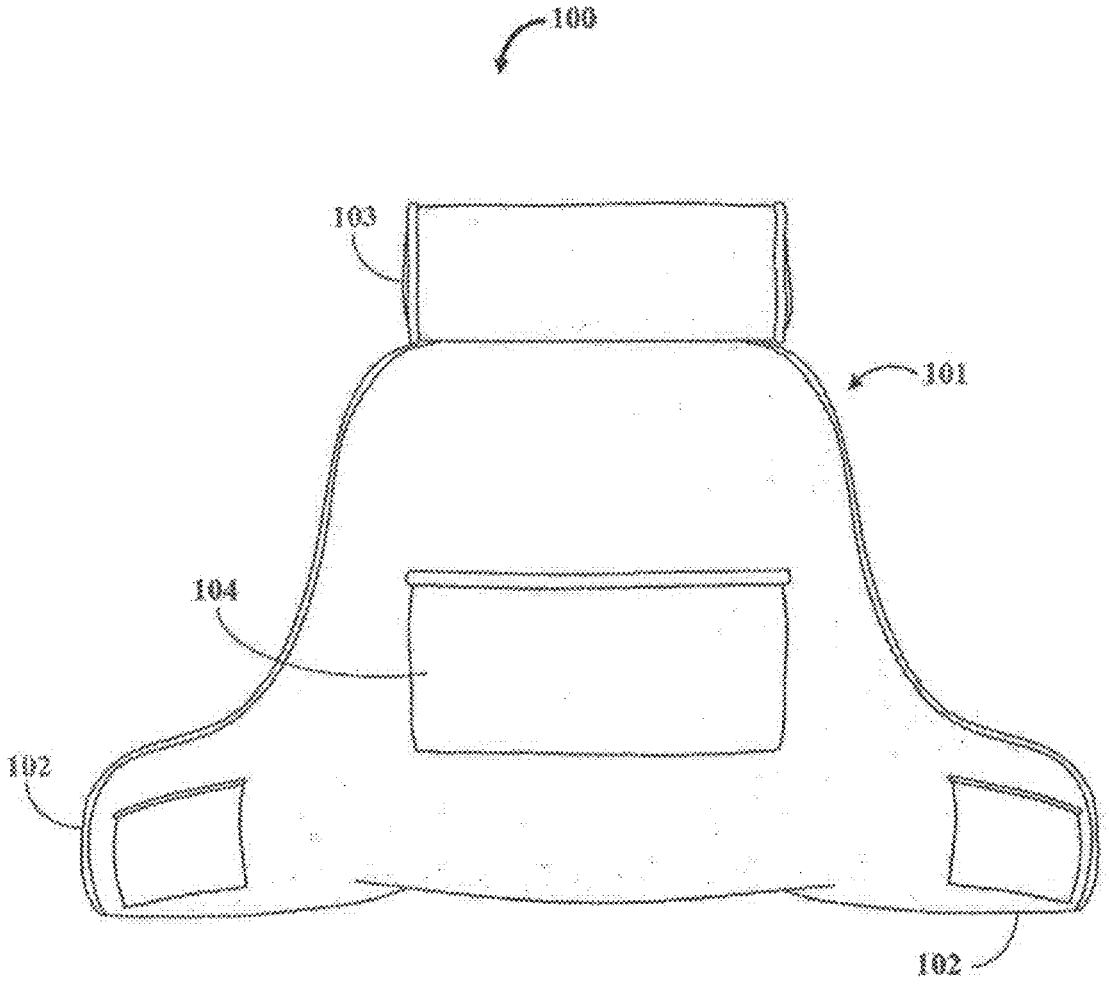
FIG. 11 exemplarily illustrates a rear elevation view of the pillow of FIG. 9.
Figure 12:
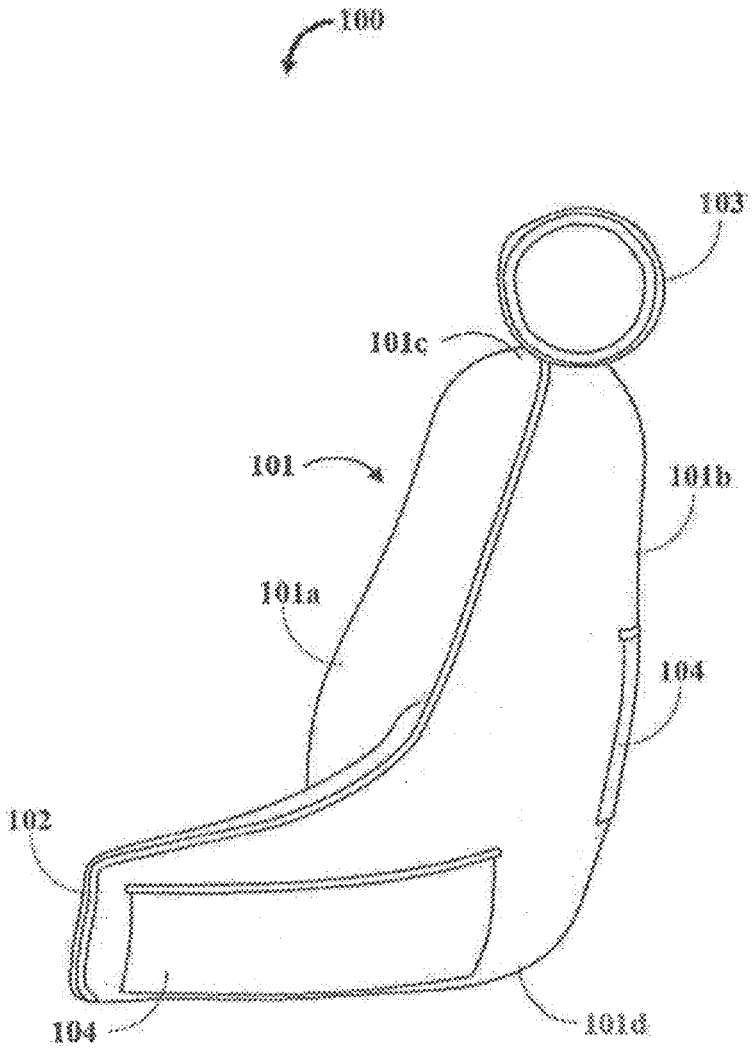
FIG. 12 exemplarily illustrates a right-side elevation view of the pillow of FIG. 9.

FIG. 11 exemplarily illustrates a rear elevation view of the pillow 100. FIG. 12 exemplarily illustrates a right-side elevation view of the pillow 100. In an embodiment, the storage compartments 104 are configured on the rear surface 101*b* of the central support pillow 101 and the outer surfaces of the arm support members 102 as exemplarily illustrated in FIGS. 11 and 12. The storage compartments 104 store one or more objects, for example, headphones, e-book readers, laptops, remotes of nearby appliances, spectacles, etc. The storage compartments 104 may be open pouches or pockets or sealable compartments having zip fasteners to seal the storage compartment 101. The neck support member 103 is detachably attached to the top surface 101*c* of the central support pillow 101. In an embodiment, the neck support member 103 is adjustable and detachably attached using one or more attachment members 104 such as snap fasteners, hook and loop fasteners, bungee cords, or drawstrings. In an embodiment, the attachment members 104 are elongated. In an embodiment, the attachment members 104 are flexible and may be stretchable. The pillow 100 may include a closed loop or handle 105 attached by a suitable mechanism such as stitching to the central support pillow 101. The pillow 100 may entirely be housed within a removable fabric cover that can be washed periodically to prevent dirt from accumulating on the surface of the pillow 100.

Figure 13:
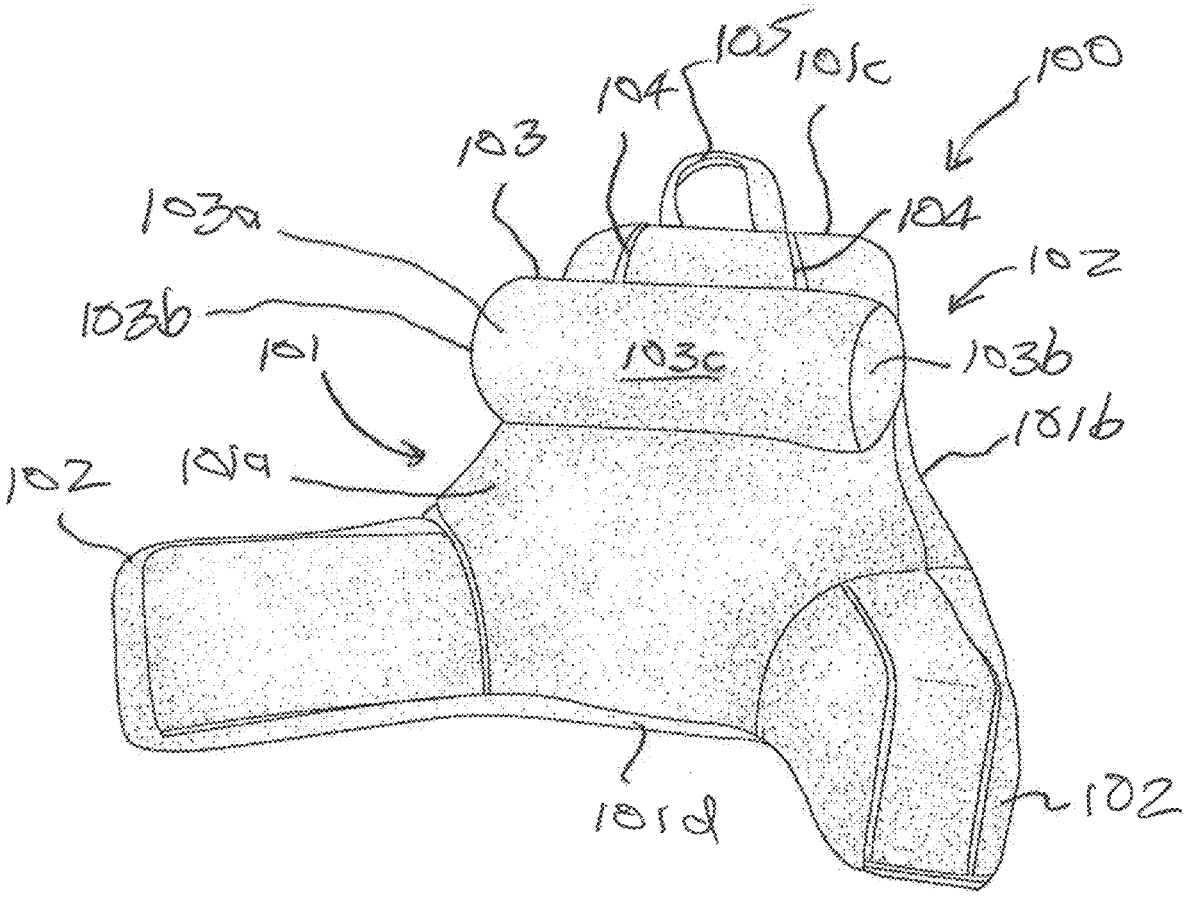
FIG. 13 is a front perspective view of the pillow with the neck support member positioned downwardly in a first position from that shown in FIG. 9.
Figure 14:
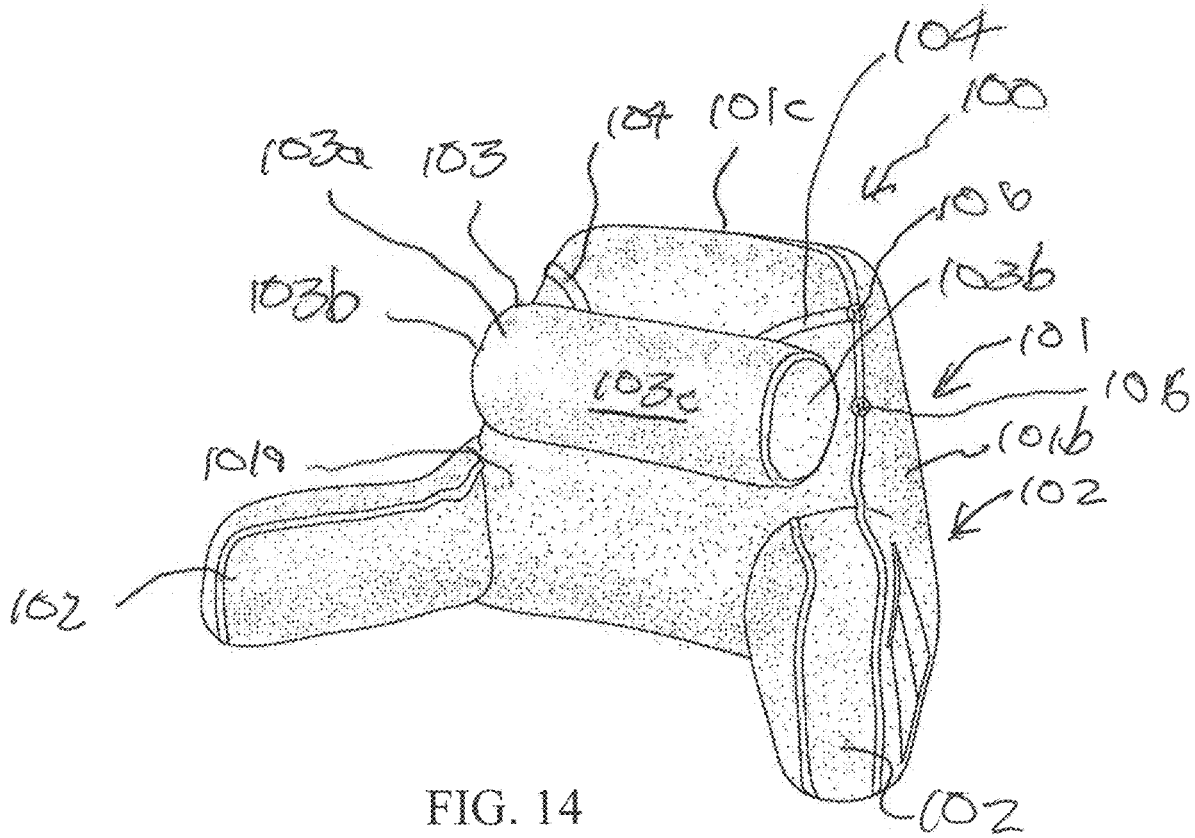
FIG. 14 is a front perspective view of the pillow with the neck support member positioned downwardly in a second position from that shown in FIG. 9.
Figure 15:
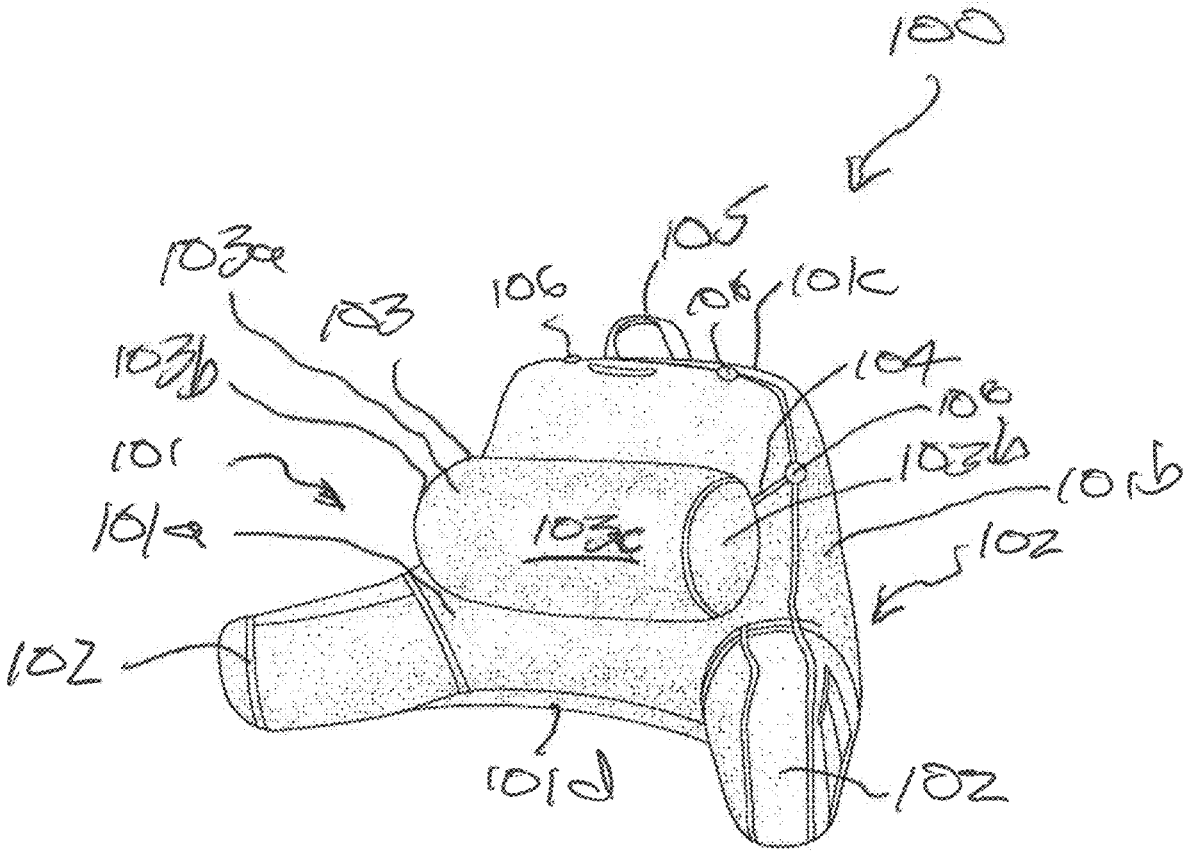
FIG. 15 is a front perspective view of the pillow with the neck support member positioned downwardly in a third position from that shown in FIG. 9.

As illustrated in FIG. 13, the neck support member 103 is adjusted relative to the top surface 101*c* of the central support pillow 101 and positioned downwardly in a first position from that shown in FIG. 9. As illustrated in FIG. 14, the neck support member 103 is adjusted relative to the top surface 101*c* of the central support pillow 101 and positioned downwardly in a second position from that shown in FIG. 9. As illustrated in FIG. 15, the neck support member 103 is adjusted relative to the top surface 101*c* of the central support pillow 101 and positioned downwardly in a third position from that shown in FIG. 9. It should be appreciated that the neck support member 103 may be adjusted to other positions relative to the top surface 101*c* of the central support pillow 101 than that illustrated.

Figure 16:
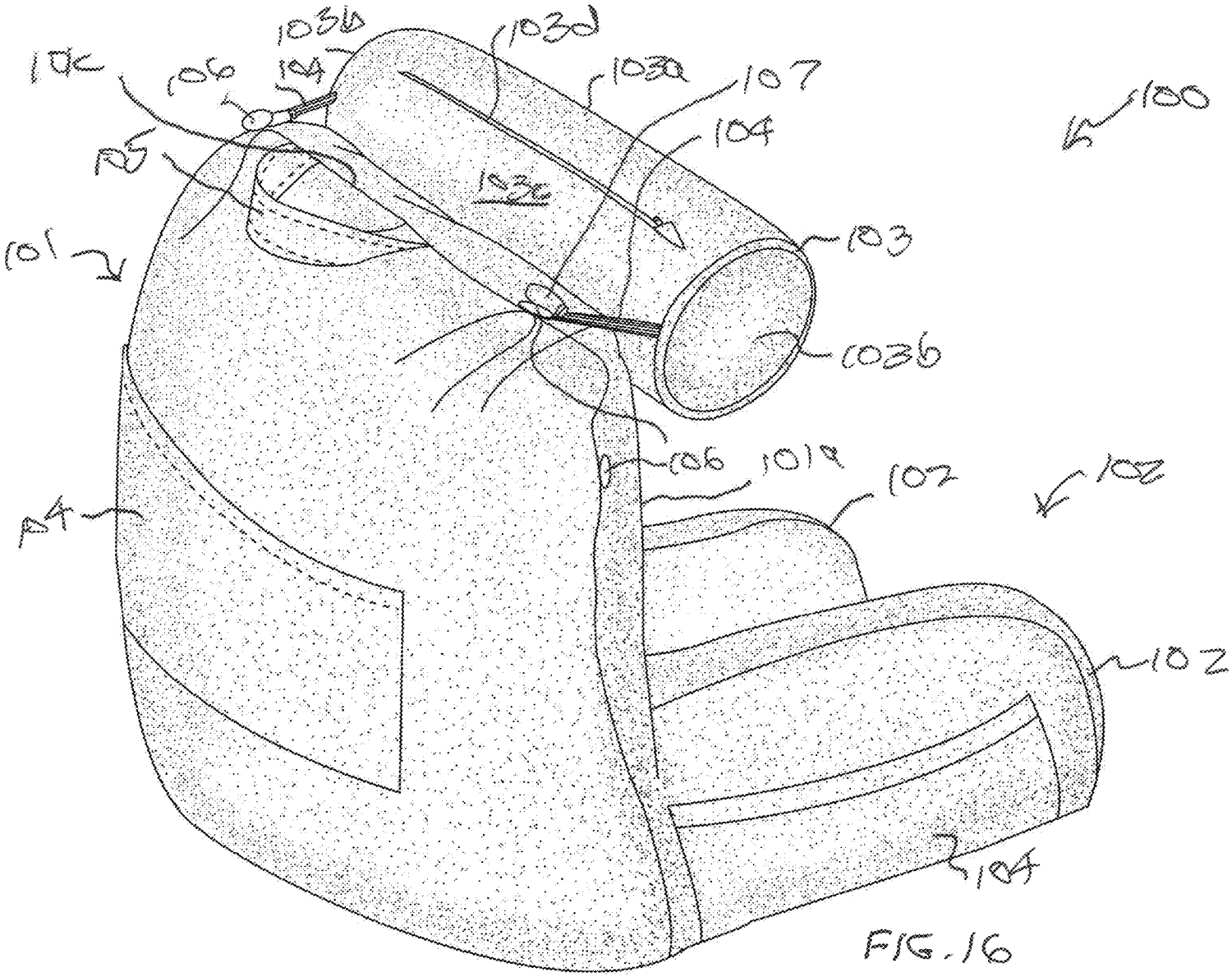
FIG. 16 is an enlarged rear perspective view of the pillow with the neck support member in a position from that shown in FIG. 9.
Figure 17:
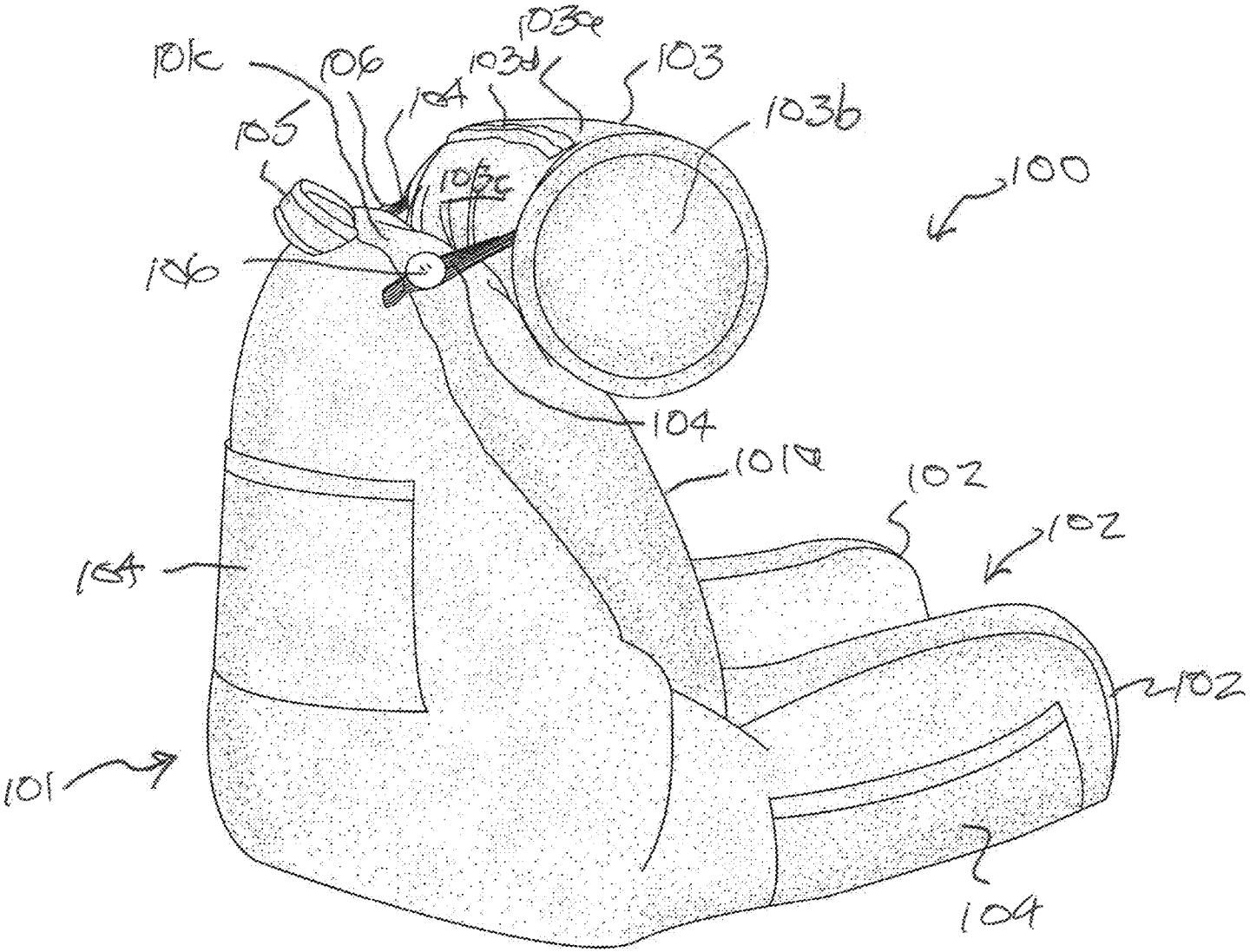
FIG. 17 is an enlarged side perspective view of the pillow with the neck support member in a position from that shown in FIG. 9.
Figure 18:
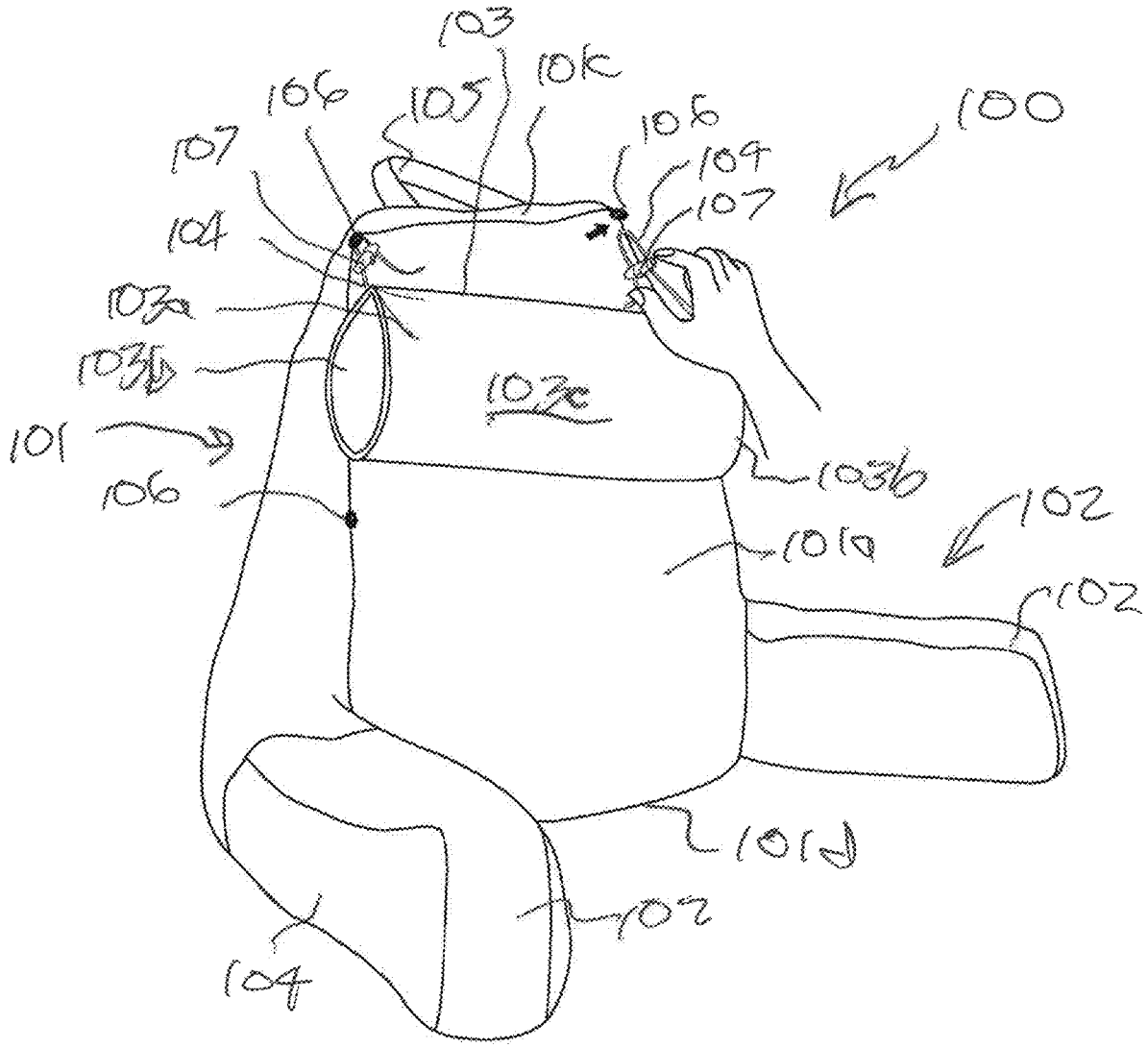
FIG. 18 is an enlarged front perspective view of the pillow with the neck support member being adjusted in a position by a hand of a human operator.

Referring to FIGS. 14-18, the pillow 100 includes one or more anchors 106 at fixed positions on the central support pillow 101. In one embodiment, the anchors 106 may be a button attached by a suitable mechanism such as stitching to the central support pillow 100. As illustrated in FIG. 14, the anchors 106 are at fixed positions along a seam of the central support pillow 101. As illustrated in FIG. 15, the anchors 106 are at fixed positions along the top surface 101 and a side surface of the central support pillow 101. As illustrated in FIG. 16, the attachment members 104 are attached to the anchors 106 by looping around the anchors 106. In one embodiment, the pillow 100 may include an adjuster 107 on the attachment member 104 to allow an adjustable length of the attachment member 104. As illustrated in FIG. 17, the attachment member 104 may be fixed in length by a suitable mechanism such as stitching such that the end of the attachment member 104 extends beyond the anchor 106. As illustrated in FIG. 18, the attachment member 104 may extend through the adjustor 107 and a hand of a human operator may be used to compress the adjustor 107 and allow the length of the attachment member 104 to be adjusted to remove or apply the attachment member 104 about the anchor 106. It should be appreciated that when the adjustor 107 is released by the hand of the human operator the length of the attachment member 104 is fixed.

The foregoing examples have been provided merely for the purpose of explanation and are in no way to be construed as limiting of the integrated pillow 100, disclosed herein. While the integrated pillow 100 has been described with reference to various embodiments, it is understood that the words, which have been used herein, are words of description and illustration, rather than words of limitation. Further, although the integrated pillow 100 has been described herein with reference to particular means, materials, and embodiments, the integrated pillow 100 is not intended to be limited to the particulars disclosed herein; rather, the integrated pillow 100 extends to all functionally equivalent structures, methods and uses, such as are within the scope of the present invention. Although there has been shown and described the preferred embodiment of the present invention, it will be readily apparent to those skilled in the art that modifications may be made there.

What is claimed is:

1. A pillow for ergonomically supporting a user comprising:

a central supporting pillow having at least two arm support members extending from the central supporting pillow;

an adjustable neck support member being cylindrical in shape and having an outer surface; and a bungee cord attached to the neck support member and the central support pillow, wherein the neck support member is freely adjustable and detachably attached using the bungee cord, the bungee cord having one end attached to a top surface of the central supporting pillow and another end attached to the outer surface of the adjustable neck support member to ergonomically support a back and a neck of the user.

2. The pillow as claimed in claim 1, including a plurality of storage compartments on an exterior of the at least two arm support members and a rear of the central supporting pillow to allow temporary storage of one or more objects.

3. The pillow as claimed in claim 1, wherein an exterior of the central supporting pillow, the at least two arm support members, and the neck support member is made of natural or synthetic fiber comprising one of polyester, rubber, cotton, and leather.

4. A pillow for ergonomically supporting a user comprising:

a central supporting pillow having at least two arm support members extending from the central supporting pillow;

an adjustable neck support member having a cylindrical portion and opposing end portions; and a bungee cord attached to the neck support member and the central support pillow, wherein the neck support member is freely adjustable and detachably attached using the bungee cord, the bungee cord having one end attached to a top surface of the central supporting pillow and another end attached to the cylindrical portion of the adjustable neck support member to ergonomically support a back and a neck of the user.

5. The pillow as claimed in claim 4, including a plurality of storage compartments on an exterior of the at least two arm support members and a rear of the central supporting pillow to allow temporary storage of one or more objects.

6. The pillow as claimed in claim 4, wherein an exterior of the central supporting pillow, the at least two arm support members, and the neck support member is made of natural or synthetic fiber comprising one of polyester, rubber, cotton, and leather.

* * * * *